United States Patent [19]

Traegaardh

[11] Patent Number: 5,033,975

[45] Date of Patent: Jul. 23, 1991

[54] METHOD OF AND A DEVICE FOR RAISING FLATTENED PARALLELEPIPEDIC BLANKS

[75] Inventor: Paul Traegaardh, Tokyo, Japan

[73] Assignee: AB Tetra Pak, Lund, Sweden

[21] Appl. No.: 397,245

[22] Filed: Aug. 23, 1989

[30] Foreign Application Priority Data

Aug. 24, 1988 [JP] Japan ..... 63-209701

[51] Int. Cl.[5] ..... B31B 1/78

[52] U.S. Cl. ..... 493/310

[58] Field of Search ..... 493/309, 310, 313, 319

[56] References Cited

U.S. PATENT DOCUMENTS

| | | | |
|---|---|---|---|
| 2,241,817 | 5/1941 | Howard | 493/310 |
| 3,044,371 | 7/1962 | Gastright | 493/309 |
| 3,187,646 | 6/1965 | Monroe et al. | 493/310 |
| 3,293,998 | 12/1966 | Farnow | 493/310 |
| 3,418,894 | 12/1968 | Jivoin | 493/309 |
| 4,057,008 | 11/1977 | Hughes | 493/310 |
| 4,493,687 | 1/1985 | Bernle | 493/310 |
| 4,530,692 | 7/1985 | Williams | 493/309 |
| 4,573,957 | 3/1986 | Billberg | 493/310 |
| 4,708,707 | 11/1987 | Koike et al. | 493/313 |

FOREIGN PATENT DOCUMENTS

| | | |
|---|---|---|
| 57-163615 | 3/1982 | Japan . |
| 59-209512 | 3/1984 | Japan . |

*Primary Examiner*—D. S. Meislin

[57] ABSTRACT

A method and device are disclosed for raising rimpled and flattened parallelepipedic blanks to form rectangular parallelepipeds. A supply of flattened parallelepipedic blanks are rolled out in a first rolling direction through a pair of discharging rollers. Pressure is imparted on the flattened parallelepipedic blanks in a direction opposite to the first rolling direction by means of a pusher for opening the blank to nearly 180° in a direction perpendicular to the rolling direction. The pusher is thereafter retracted in the first rolling direction to raise the blank to form a rectangular parallelepiped with a substantially square-shaped cross section. The formed blanks are thereafter unloaded from the device.

8 Claims, 4 Drawing Sheets

METHOD OF AND A DEVICE FOR RAISING FLATTENED PARALLELEPIPEDIC BLANKS

BACKGROUND OF THE INVENTION

1. Field of the Invention

This invention relates to a method of and a device for raising flattened parallelepipedic blanks to form rectangular parallelepipeds with a square-shaped cross section in the course of their conveyance.

2. Description of Background Art

Conventionally, various paper containers are made to fit various purposes, e.g., disposable packing containers for containing liquid foods such as milk. The packing containers are supplied in the form of rimpled and flattened parallelepipedic packing container blanks. The bottoms of the containers are closed by an automatic packing machine. Thereafter, the blanks are formed into containers with an open top. Subsequently, liquid food, such as milk, may be charged at the charging station of the automatic packing machine.

In the case of packing container blanks, packing material is cut to have an outline that enables it to be reformed into a complete packing container without additional cutting. Rimples are formed in the blanks and the longitudinal sides are sealed to form a packing container blank with a square-shaped cross section. In effect, the blank is formed to be a flattened parallelepiped for the convenience of storage and transportation. The parallelepipedic blanks require a device for raising the flattened packing container blanks into blanks with a square-shaped cross section before charging the contents at the filling station of the automatic packing machine, in order to form blanks with a sealed bottom and an open top.

Several devices have been conceived to raise flattened packing container blanks into blanks with a square-shaped cross section. These devices are located at the mandrel wheel mount of the automatic packing machine (hereinafter called "packer"), and generally each packing container blank is taken out of an outlet end of a magazine that houses a pile of packing container blanks while being held by a suction head. During this time, packing container blanks are reformed to have a square-shaped cross section and transferred to the lifting conveyor to be loaded onto the mandrel of the rotating mandrel wheel one after another. At this station, the bottoms of the blanks are formed.

Such a device for forming blanks to have a square-shaped cross section with the help of cams and rollers during a rotational transfer of blanks which are held by the rotational transferring device of a suction head using a link mechanism is cited in the Japanese Patent Disclosure Report No. 57-163615. This device maintains the shape of the square-shaped cross section after changing its shape to a rhomb so that the rectangular parallelepipedic blank will not return to the flattened shape due to bending. Also, a device not using a suction head is reported in the Japanese Patent Disclosure Report No. 59-209512, wherein the device raises a packing container blank that is being transferred by conveyor to form a square-shaped cross section using arms and hooks. In such embodiment, overfolding of the section to a rhomb is prevented when forming the section to a square.

OBJECTS OF THE INVENTION

A previous embodiment of raising each blank drawn out from the magazine one after another while being held by a suction head does not consider overfolding. On the other hand, the above two disclosure reports cite embodiments that involve overfolding to form a square-shaped cross section. However, the mechanism to raise blanks to form a square-shaped cross section is complicated. In addition, the overfolding disclosed is a modified rhomb with a large minor axis. This means the overfolded past square is not effective enough to eliminate the initial folding tendency, making it difficult to maintain the square-shaped cross section when the blank is raised. Thus, the smoothness is lost at the time of insertion to the mandrel. Moreover, in the case of the conventional raising device, when raising the flattened blank to form a square-shaped cross section, the flat and folded interfacing surfaces were sometimes bent in an unseparated manner. This resulted in a twisted section of non-square shape making the mounting on the mandrel impossible.

The present invention was made in the light of the above problems, with a purpose of supplying, with a simple configuration, a concrete method of raising and a device for raising flattened parallelepipedic blanks to form a square-shaped cross section so that they can be loaded smoothly on the mandrel by eliminating the flattening tendency. In addition, the present invention provides a method of and a device for eliminating the trouble of twisted blanks caused by raising with a closed top.

SUMMARY OF THE INVENTION

In order to achieve the above purposes, the present invention employs a method of raising rimpled and flattened parallelepipedic blanks in which the front edge of a flattened parallelepipedic blank rolled by a pair of discharging rollers is pushed in the direction opposite to the rolling direction by a pusher to open the blank nearly 180° perpendicular to the rolling direction and the pusher is moved backward to raise the blank to form a square-shaped cross section.

For raising blanks, it is effective to open a pair of interfacing walls on the front end side slightly prior to pressing the front end of the blank rolled out by the above mentioned pair of rollers in the direction opposite to the rolling direction.

Also, it is preferable that consecutive rolling of blanks by a pair of discharging rollers is synchronized with the pressing of the pusher in the direction opposite to the rolling direction and its backward movement, and the discharging of the rectangular parallelepipeds with the square-shaped cross section.

Further, the present invention provides a device to perform the above mentioned method. At least a lifting conveyor synchronizes the loading of flattened parallelepipedic blanks into the gap between a pair of discharging rollers at a constant pitch. The lifting conveyor is installed in front of a pair of discharging rollers. The blank discharging side of the discharging rollers includes a blank supporter installed to support, in the perpendicular direction to the pushing direction, both ends of blanks that are opened with pressure on the front part, and at the same time to support raised blanks with square-shaped cross section. A pusher is provided for pressing the front edge of the flattened parallelepipedic blank that passed through the discharging rollers along the blank rolling line by the discharging rollers. In addition, a pusher moving means is operatively connected to the pusher for moving the pusher in a forward and a retracted manner to allow, by retracting from the above mentioned roller side, the maintaining of the position where the section of the blank is square. The pusher moving means is installed after the pusher reaches the position where the blank is opened nearly 180° in the perpendicular direction to the blank rolling direction by the movement toward the above pair of rollers synchronously with blank rolling. The various members constitute a configuration which allows the raised blank with a square-shaped cross section to be loaded on the conveying means to push the blank in the longitudinal direction synchronously with the raising of the blank. It is preferred that the above pusher is formed as the receptacle opens 90° across the blank rolling line.

On the discharging side of a pair of discharging rollers, it is preferred that the above device is equipped with a front member opening means for opening a blank slightly prior to the above pusher moving forward to the side of the above rollers, facing at least one side of the pair of interfacing walls at the front part of the discharged blank.

Also the above front member opening means should consist of a front member lever formed of a contacting lever that is rotatable while contacting the front edge of the blank moving along the pushing line of the blank rolled out through a pair of discharging rollers. A pressing lever is provided that opens the above pair of walls slightly from a folded condition by pressing a protruding portion of one of the pair of interfacing walls at the front end of the blank while facing the protruding portion.

Another possible arrangement provides at least a pair of blank raising members equipped with at least a pair of discharging rollers. A blank supporter and a pusher moving means is set up next to two rows of manufacturing lines. A blank lifting conveyor carries blanks to the raising members and is positioned over the one main conveyor mounted horizontally and in the front and rear of the conveying direction. A guide plate for conveyance direction change that is freely advanced and retracted in relation to the conveyance surface of the main conveyor is set up below the front lifting conveyor in order to guide the conveyed blanks from the main conveyor to the lifting conveyor. A fixed guide plate for changing conveyance direction is positioned below the rear lifting conveyor. The above movable guide plate is driven synchronously with the above lifting conveyors and the main conveyor to guide the blanks consecutively carried on the main conveyor alternately to the above front and rear lifting conveyors to load between the above pair of discharging rollers.

When the above method is used to raise a rimpled and flattened parallelepipedic blank to form a rectangular parallelepiped with a square-shaped cross section, the flattened and folded inclined blank is pressed hard, in the course of deformation, to fold a pair of rimples on the unfolded walls in the manner that adjoining walls on each of the pair of unfolded walls interface each other. The original rimples are folded in the direction which nullify the folding inclination. Thus, when the cross section is formed back to the square, the blank tends to maintain a square-shaped cross section, and mounting on the mandrel after raising is smoothly performed when forming a container from the flat parallelepipedic blank. In addition, problems such as twisting when pressed with a pusher when a blank is forced open prior to being raised to form a rectangular parallelepiped can be avoided.

Also the raising device is equipped with a blank supporter that steadily opens a flattened blank rolled out by a pair of rollers to nearly 180° in the perpendicular direction to the rolling direction using a pusher to form securely a longitudinal rimple for making a blank with a square-shaped cross section, and by synchronizing the pushing of a blank into the raising member and raising movement of a blank to form a square-shaped cross section with the use of a pusher, parallelepipedic blanks can be raised consecutively and efficiently. Also the 90° opening across the pushing line of the receptacle of the pusher allows steady formation of the square-shaped cross section of the blanks. Also, depending on the shape of the parallelepipedic blanks, the rotation of the front part opening lever by the movement of the blank can push up the protrusion of one of the pair of interfacing walls on the side of the blank, and a small opening can be made prior to raising of the square-shaped cross section in order to avoid the negative pressure inside the blank.

Also the main conveyor coupled with a movable guide plate and a fixed guide plate for changing the conveyance direction, can change the conveyance direction of the blanks conveyed from the one main conveyor alternately, making it possible to load the blanks onto two rows of blank raising devices.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENT

A method of and the device for the present invention shall be explained in the case of a flattened parallelepipedic blank used as a packing container for liquid foods such as milk.

The packing material forming the packing container blank is constructed of a central supporting layer made of paper, the sides of which are coated with a liquid-tight thermoplastic layer such as polyethylene or an airtight layer such as aluminum foil depending on the use.

Figure 5:
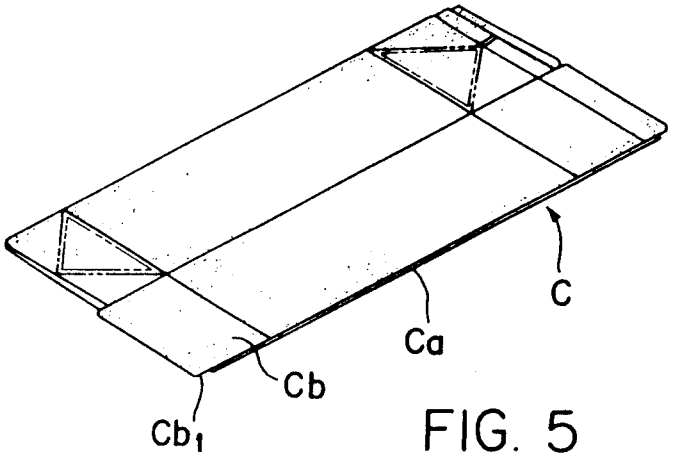
FIG. 5 is a diagonal view of a flattened parallelepipedic blank.
Figure 6:
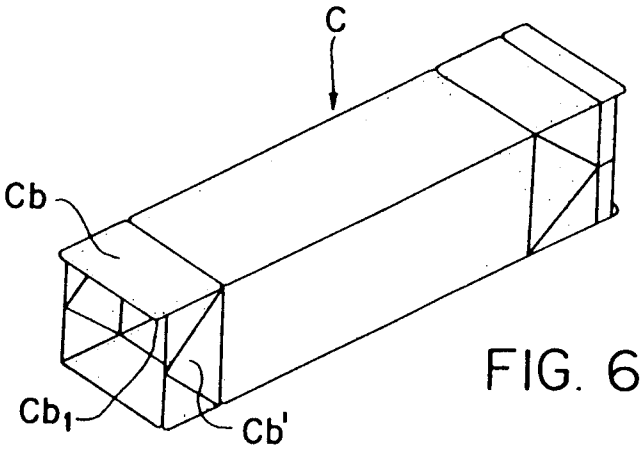
FIG. 6 is a diagonal view of a raised parallelepipedic blank with a square cross section.

The packing material is cut in the prescribed shape, and after being rimpled to facilitate folding and forming, a longitudinal folding line to form a joining edge and a folding line to face the folding line at the time of container forming, are folded and the two longitudinal edges are joined and sealed to be converted to a flattened parallelepipedic blank C, as illustrated in FIG. 5. The flattened packing containers C are piled in a prescribed amount for transportation and then wrapped. The containers are carried to a packer for filling, unwrapped and piled in magazines. The packing container blanks are raised to form a square-shaped cross section before being converted to packing containers inside the packer, as illustrated in FIG. 6. When shape is given to the packing container blanks C, the blanks are loaded onto the packer one after another to be filled with a product and converted into sealed packing containers. In the case of known packers, packing container blanks raised to form a square-shaped cross section are ordinarily loaded onto the mandrel wheel of the packer. The packing container blanks are formed with a bottom member by folding and sealing during rotation of the mandrel wheel. Thereafter, the packing container blanks are transferred to the conveyor, and go through the filling station thereon to be filled with the desired contents. Subsequently, the containers are folded and sealed at the top to form the complete packing container.

Figure 1:
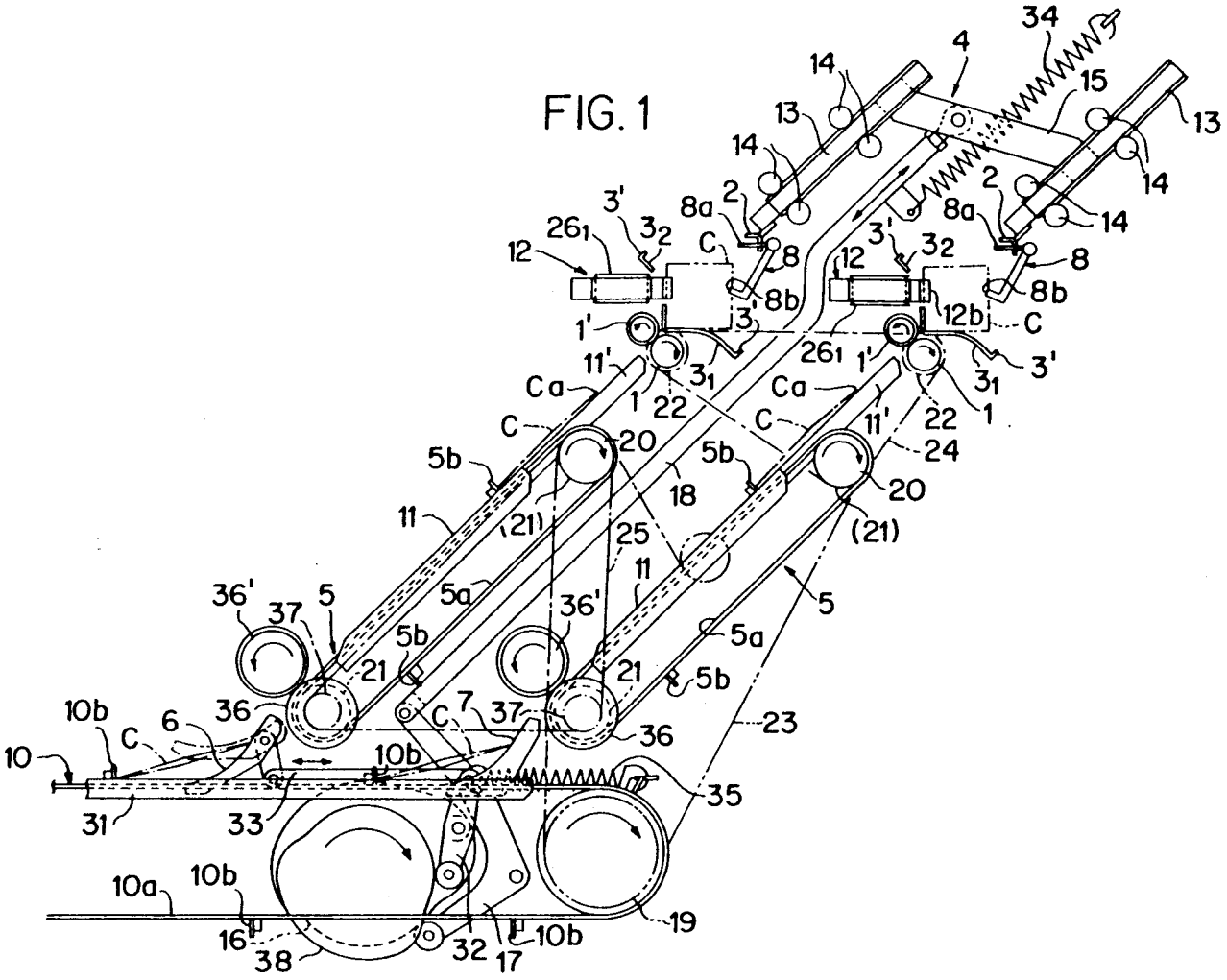
FIG. 1 is a front view showing two rows of packing container blank raising devices and their relationship with the main conveyor for supplying blanks to the devices.

FIG. 1 is a side view showing the relationship between the two rows of packing container blank raising devices in the front and rear. A main conveyor 10 supplies blanks to the raising devices.

The two rows of raising devices located in the front and rear in relation to the conveyance direction of the main conveyor 10, are respectively equipped with a pair of discharging rollers 1 and 1' that serve to push flattened parallelepipedic blanks C into the blank raising members where they are raised to form a square-shaped cross section. One of the rollers 1' is disposed diagonally above the others and includes an elastic body, such as an O-ring, embedded onto the surface to be able to hold pushed blanks C. In front of raising devices 1 and 1' are lifting conveyors 5 for loading flattened parallelepipedic blanks C at a constant pitch between the discharging rollers 1 and 1' synchronously with the rotation of the discharging rollers and conveying blanks diagonally upward at an angle of 45°. On each of the conveyors, two pushing claws **5*b* for pushing blanks C are set up at two places so they divide the conveyor length equally into two. On both sides of a timing belt 5*a*, a blank supporting rail 11 with a blank siding surface slightly above the upper surface of the timing belt 5*a* is set up coupled with an auxiliary supporting plate 11' having a sliding surface at the same level as the sliding surface, so that when the timing belt 5*a* moves, the blank C is moved diagonally upward and is pushed by the pushing claw 5*b***.

Figure 2:
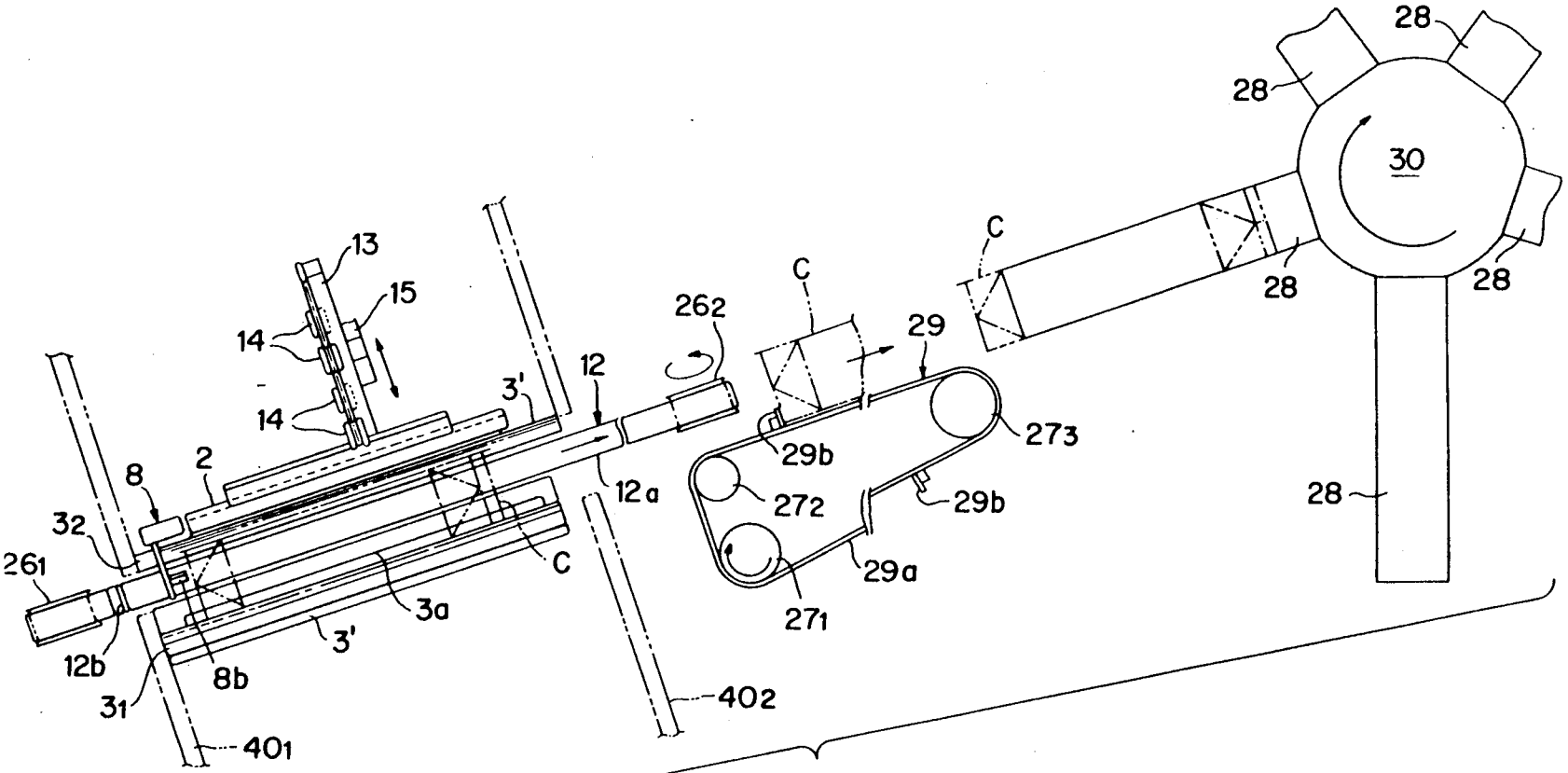
FIG. 2 is a side view showing a blank travelling path from one of the blank raising devices in FIG. 1 to the mandrel wheel.

The lifting conveyor 5 is equipped with timing belts **5*a*, blank supporting rails 11, and auxiliary supporting plates 11' to be able to accommodate the longitudinal dimension of the blank C. On the blank discharge side of the above pair of rollers 1 and 1', are blank supporters $3_1$ and $3_2$, each equipped with a raising member 3' for supporting both sides of the blank C pressed-opened across the rolling line at the front edge by the pusher mentioned later in the perpendicular direction to the rolling direction. At the same time support blanks are raised to form a square-shaped cross section. The pair of blank supporters $3_1$ and $3_2$, are set above and below the path of the pushing claw 12*b* of an unloading conveyor 12 as discussed hereinbelow. Both sides across the pushing line of the above blank of the lower blank supporter $3_1$, are open 90° to support and guide the corner of the blank C that has a square-shaped cross section. One of the open sides leads to the raising member 3' on the edge via a circular plane. Also the blank supporter $3_1$ includes a window 3*a* cut-open at a prescribed width and length in the central part that is open for 90° across the above pushing line, whereon a path for a blank C rolled out from the pair of rollers 1 and 1' is formed, as illustrated in FIG. 2. Also, on the above rolling line, a pusher 2 for receiving and pressing an edge Ca of a flattened blank C that passed through the discharging rollers 1 and 1', is attached at the tip of the moving lever 13 which is guided by four grooved guide rollers 14**, and is mounted for being moved forward and being retracted.

A pair of left and right moving levers 13, 13 of the two packing container blank raising devices in the front and rear, are adhered to each other by a link 15 to move as a unit. The link 15 is forwarded and retracted, between lower left and upper right, as illustrated in FIG. 2, via a linking rod 18 that is positioned in the diagonally upward direction with a spring 34 from a crank lever rocked by a pusher driving cam that rotates synchronously with the movement of a conveyor 10 on the side of the conveyor 10, the side to the left of the conveyance direction of the conveyor. That is, while the pusher drive cam 16 rotates one cycle, pushers 2, 2 at the tip of a pair of moving levers 13, 13 on the left and right reciprocate one cycle at a prescribed movement process synchronously with a rotation of the above cam 16. A pair of front and rear lifting conveyors 5, 5 are synchronously driven with timing pulleys 20, 20 at the upper edge of a pair of lifting conveyors 5, 5 driven via a timing belt 23 by the timing pulley 19 at the upper edge of the main conveyor 10 which is driven at the same time as the above cam 16.

A pair of front and rear discharging rollers 1, 1 are rotated by timing pulleys 22, 22 linked with the discharging rollers 1, 1 that are located, via a timing belt 24, upward from the timing pulleys 21. The timing pulleys 21 are on the same axis and of the same diameter as the timing pulleys 20 at the upper tip of lifting conveyors 5 in the rear. The upper discharging rollers 1', 1' are gear-linked with the discharging rollers 1, 1 and are rotated at the same speed. Therefore, a pair of pushers 2, 2, a pair of discharging rollers 1, 1' and 1, 1' in the front and rear, and a pair of lifting conveyors 5, 5 are driven synchronously. Thus, each blank C moving diagonally upward by pressure from pushing claw **5*b* of each lifting conveyor 5, is rolled out from a pair of discharging rollers 1, 1', as illustrated in FIGS. 3**(*a*), 3(*b*).

In each packing container blank raising device, each pusher 2 advances toward discharging rollers 1, 1' to press-open the blank C, and to further press beyond the condition of a square-shaped cross section of the same.

Figure 3:
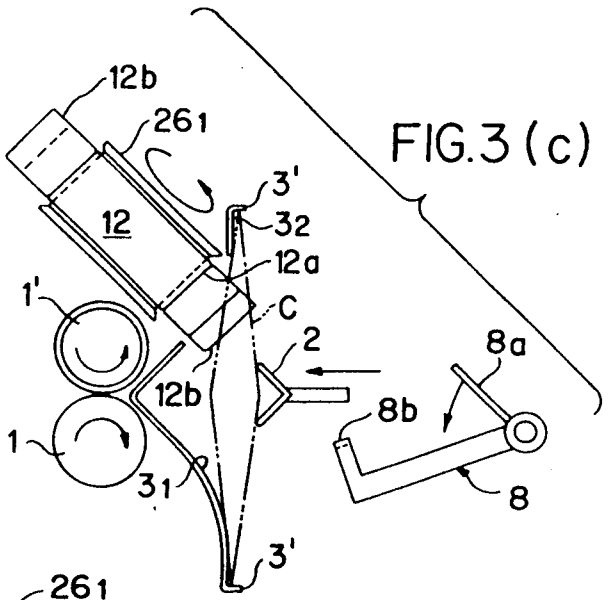
FIGS. 3(*a*), 3(*b*), 3(*c*) and 3(*d*) are front views showing the process of raising flattened parallelepipedic blanks to form a square-shaped cross section.
Figure 3:
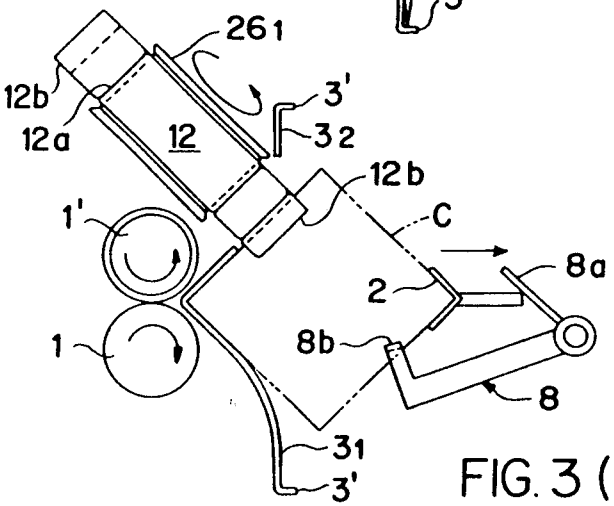
Figure 3:
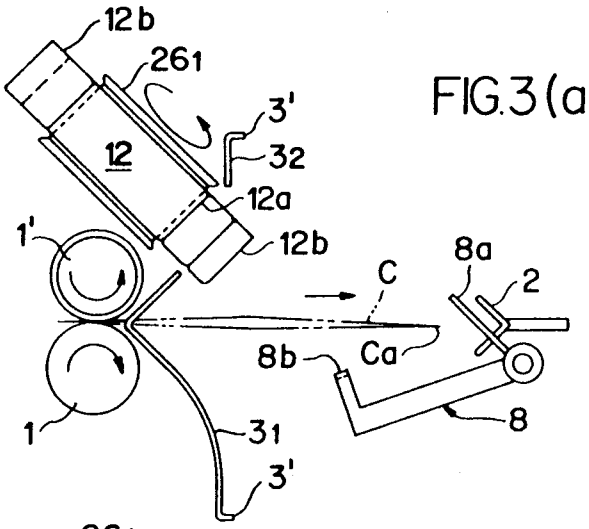
Figure 3:
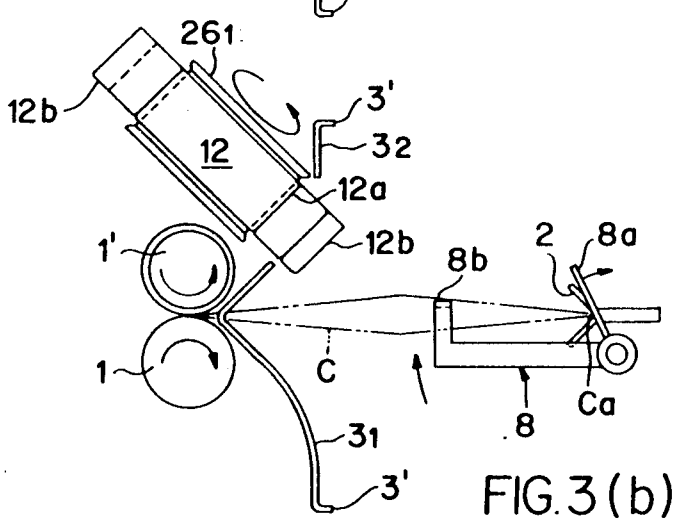
Figure 4:
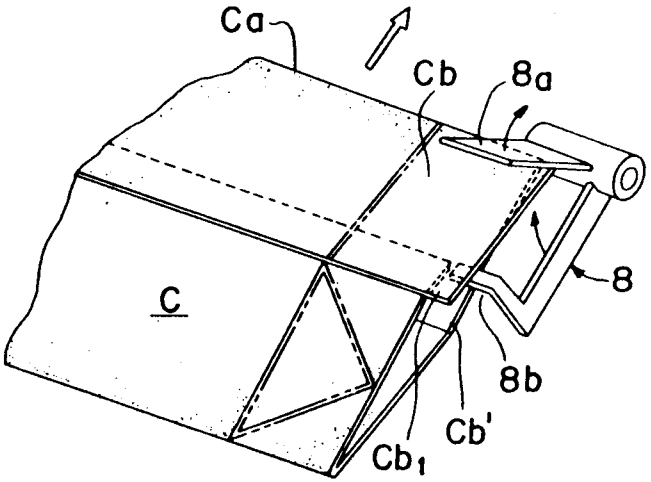
FIG. 4 is a diagonal view showing a front member opening lever opening a flattened parallelepipedic blank slightly prior to pressing by the pusher.

When the pusher 2 is pressed in to the extreme position where both sides of blank C are fixed between raising parts 3', 3' on both sides of blank supporters $3_1$ and $3_2$, blank C is opened nearly 180° in the perpendicular direction to the pushing direction, as illustrated in FIG. 3(*c*). Thereafter pusher 2 withdraws from the discharging rollers 1, 1' side and returns to the original position after maintaining, for a prescribed time, the position where blank C has a square-shaped cross section as illustrated in FIG. 3(*d*). When the above blank C is raised, the unloading conveyor 12 loads the parallelepipedic blank C with a square-shaped cross section to the mandrel wheel 30 side, as illustrated in FIG. 2, inside the packer in the longitudinal direction. Pushing claw 12*b* does not go into the blank raising member comprising blank supporters $3_1$, $3_2$ and moves synchronously so that the blank C is rolled out during the time when it is raised to form a rectangular parallelepiped with a square-shaped cross section. A first stage opening lever 8 is mounted on the latitudinal side of a blank on the rolling line of blanks C from the above pair of rollers 1, 1'. The contact lever 8*a* rotates while contacting the front edge Ca of the blank C that is rolled out. Also, the first stage opening lever 8 is equipped with a pressing lever 8*b* which faces a projection $Cb_1$ on one of the pair of bottom forming walls Cb and Cb' interfacing with each other on the contacting initial blank front edge side. When the contact lever 8*a* is pushed and rotated by movement of the blank C, the pressing lever 8*b* projection $Cb_1$ to open the blank C a little from a folded condition. Thereafter the blank C advances to the point where the above mentioned walls Cb and Cb' are open, as illustrated in FIG. 4. Pusher 2 starts advancing towards rollers 1, 1' to widely open the blank that is already open slightly.

Each blank entrance in the lower part of the above mentioned front and rear lifting conveyors 5, 5 has a speed increasing timing pulley 37 mounted on the timing pulley 21 to have the same axis and rotates independently of the timing pulley. Each speed increasing timing pulley 37 is rotated at an increased speed via timing belt 25 from timing pulley 21 of the same axis and the same diameter as the timing pulley 20 at the upper part of the left lifting conveyor 5. The circumferential speed of the feeding roller 36 which is fixed with the speed increasing timing pulley 37 on the same axis is increased by four times as the conveyance speed of the above mentioned lifting conveyor 5. The other feeding roller 36' with a resilient material such as an O-ring embedded on the circumference as if to contact the circumference of the feeding roller 36, is mounted facing the latter via gear linkage so as to rotate at the same speed as that of the above mentioned roller 36. The blank C guided from the lower part is inserted between the pair of feeding rollers 36, 36' and loaded rapidly onto the lifting conveyor 5 at a speed faster than the conveyance speed of the lifting conveyor 5 so that the blank does not conflict with pushing claw 5*b*. The feeding rollers 36, 36 in the lower part of the above mentioned two rows of lifting conveyors 5, 5 in the front and rear, are mounted near and above the one main conveyor 10 that consecutively conveys blanks C withdrawn one after another from left and right magazines not illustrated. In the front lower part of the blank entrance of the feeding rollers 36, 36' in the front, as illustrated to the left in FIG. 1, is a guide plate for conveyance direction change that is freely advanced and retracted in relation to the main conveyor 10 conveyance surface.

The guide plate 6 is provided for changing the conveyance direction and vibrates synchronously with the movement of the pushing claw 10*b* moving together with the main conveyor via vibrating levers 32, 33 connected with movable guide plate direction change cam 38 adhered to the above mentioned pusher driving cam 16 on the same axis. Guide blanks C, moving on the blank supporting rail 31 by the pressure of pushing claws 10*b*, are transported at a constant pitch on the timing belt 10*a* of the main conveyor 10 into the gap between the feeding rollers 36, 36' one after another. In the front lower part of the blank entrance of the feeding rollers 36, 36', positioned in the rear right hand side of FIG. 1, a guide plate that is stable in relation to the conveyance surface of the main conveyor is set up. The guide plate guides blanks C sent one after another by the pushing claw 10*b* from the blank supporting rail 31 into the gap between the pair of feeding rollers 36, 36' in the rear upper portion. Thus, blanks C conveyed consecutively on the one main conveyor 10 are guided simultaneously into the two lifting conveyors 5, 5 in the front and rear, and are raised simultaneously to form a square-shaped cross section.

Meanwhile, each blank C raised to have a square-shaped cross section at each blank raising member is discharged in the longitudinal direction by each unloading conveyor 12 facing the blank raising member. Each unloading conveyor 12 is mounted to extend at a right angle relative to the front. The pushing claws 12*b* are mounted on the unloading conveyor suspended between a timing pulley $26_1$ mounted on the frame $40_1$ in front of the main frames $40_1$, $40_2$ on both front and rear sides on which the raising device is mounted and a timing pulley $26_2$ is mounted at a prescribed place on the rear mandrel side of the rear frame $40_2$, so as to divide the circumference of the conveyor in two, move synchronously with the raising of the blank C, pushing the blank C from the side to discharge in the direction of the mandrel wheel 30 that is on the discharging line.

The above mentioned main frames $40_1$, $40_2$ and the mandrel wheel 30 are separated by a slight gap due to arrangement considerations, and the pushing on the side of the raised rectangular parallelepipedic blank C by the pushing claw 12*b* is converted to the upward pushing by a pushing claw 29*b* on the timing belt 29*a* suspended by timing pulleys $27_1$, $27_2$ and $27_3$ of the loading conveyor 29 on the mandrel wheel 30 side. The blanks are loaded from the path guide with parallelepipedic rollers onto the mandrel 30 which rotates intermittently in a clockwise direction. That is, when the mandrel 28 connected radially to divide the clockwise and intermittently rotating mandrel wheel 30 equally into five stations is in an intermittently stopped condition, the rectangular parallelepipedic blank C raised on the mandrel 8 in the front is loaded. In the embodiment, the mandrel 28 is mounted every 72° to divide the circumference equally into five, and in order to load the blank C on the mandrel 28 in the front and adjacent to the lower mandrel 28 that stops in the vertical direction, the mandrel 28 is inclined 18° from the horizontal direction. The path for loading the blank C onto the mandrel is also inclined 18° relative to the horizontal plane, and the main frames $40_1$, $40_2$ are inclined 18° from vertical. The above mentioned front view, as illustrated in FIG. 1, shows the 18° inclination as vertical for convenience. Depending on the number of mandrels connected on the mandrel wheel 30, the inclination of the frame varies. FIG. 2 illustrates one of the paths going to the mandrel wheel 30 from two rows of unloading conveyors 12, 12.

As shown above, flattened parallelepipedic packing container blanks C are withdrawn from the magazine not illustrated, and moved onto the main conveyor 10 to be conveyed consecutively on the main conveyor 10. After being divided into two rows of lifting conveyors 5, 5 in the front and rear, the container blanks C are raised at the blank raising member to be securely and simultaneously formed into two blanks with square-shaped cross section with no possibility of flat interfacing sides sticking together unopened. The container blanks C are loaded onto the two rows of mandrel wheels from the pair of unloading conveyors.

In the above embodiment, opening of the blank that precedes raising of the blank is conducted by the front part opening lever 8, but this can be replaced by a method involving suction.

The embodiment of this invention was explained using the case of a packing container blank raising device, but without limitation to the above, in forming containers with square-shaped cross section from other types of blanks, various modifications can be made within the scope that does not deviate from the essence of this invention depending on the specification of the container.

According to a method of the present invention, rimpled and flattened parallelepipedic blanks rolled out from a pair of discharging rollers are overfolded nearly 180° past the point where the cross section is square by the pressure from the pusher. Thereafter, the pusher is moved backwards to form parallelepipedic blanks of square cross section eliminating the folding tendency and maintaining a square cross section, allowing large overfolding, which was difficult with conventional devices. The present invention secures more firm maintenance of square cross section contributing to smooth formation of containers including loading of packing container blanks.

Prior to raising flattened parallelepipedic blanks into rectangular parallelepipeds with square cross section, the flattened blanks are forced open to avoid a problem with twisted blanks due to failure to form a square-shaped cross section.

Consecutive rolling out of blanks by discharging rollers, raising of blanks to form a square-shaped cross section by the pressure and backward movement of the pusher, and discharging of raised blanks, are conducted synchronously so that the raising of the flattened parallelepipedic blanks is conducted consecutively and efficiently.

The mechanism of the present invention is equipped with discharging rollers for pushing out flattened parallelepipedic blanks, lifting conveyors for conveying blanks to the discharging rollers supporters for blanks to be raised, and a pusher moving mechanism equipped with a blank raising pusher to advance or retract according to the raising operation. Discharge of the blanks through the discharging measure is synchronized with raising of the blanks from the raising member. Thus, flattened parallelepipedic blanks are continuously and steadily raised.

The mechanism of the present invention provides for the cross section of the blank to be raised to steadily form a square because of the 90° opening of the receptacle of the pusher.

The mechanism is equipped with a front member opening measure for opening blanks slightly prior to raising the blanks to form a square-shaped cross section by a pusher. This construction avoids the problem of blanks not being raised to form a square-shaped cross section. In addition, this construction avoids twisting.

If a projection is formed on one of the pair of interfacing walls on the blank side depending on the shape of the blank, a front part opening lever of a simple construction can open the blank slightly by using the blank moving force prior to the raising of the blank. The method of the present invention is quite simple compared to the ordinary construction in which cams are used to move the opening lever.

The mechanism is equipped with a movable guide plate and a fixed guide plate for changing conveyance direction, wherein conveyed blanks are guided into one of the lifting conveyors at the raising member by the former and into the other lifting conveyor by the latter fixed guide so that blanks can be loaded onto two rows of raising devices from one main conveyor for efficient raising.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A method for raising rimpled and flattened parallelepipedic blanks to form rectangular parallelepipeds comprising the steps of:

supplying a front edge of a flattened parallelepipedic blank discharged through a pair of discharging rollers in a first direction along a discharge plane;

imparting pressure to said front edge in a second direction, said second direction being opposite to said first direction along said discharge plane, by means of a pusher for opening the angle between adjacent panels forming said front edge of said blank from substantially 0° to nearly 180° whereat each of said adjacent panels is substantially perpendicular to said first direction; and retracting said pusher in said first direction to raise said blank to form a rectangular parallelepiped with a substantially square-shaped cross section.

2. The method according to claim 1, further comprising the step of slightly opening a gap between said adjacent panels forming said front edge, said step of slightly opening a gap occurring after said step of supplying a front edge and prior to said step of imparting pressure to said front edge in said second direction.

3. The method according to claim 1, comprising the further step of removing said rectangular parallelepiped with a square-shaped cross section to an unloading conveyor, wherein said steps of supplying a front edge, imparting pressure to said front edge in said second direction, retracting said pusher, and removing said rectangular parallelepiped with a square-shaped cross section, occur synchronously.

4. A device for raising rimpled and flattened parallelepipedic blanks to form rectangular parallelepipeds comprising:

a. at least one pair of discharging rollers, each said pair of discharging rollers having an entry side and a discharge side;

b. at least one lifting conveyor, each said lifting conveyor having a first end and a second end, said first end receiving each of said blanks for conveyance to said second end, said second end being located adjacent to said pair of discharging rollers for providing a flattened and parallelepipedic blank to said entry side at a constant pitch for discharge through said pair of discharging rollers to said discharge side in a first direction along a discharge plane;

c. at least one pusher-moving mechanism, each said mechanism being located along said discharge plane opposite to said discharge side, each said mechanism having a pusher, means to advance and to retract said pusher in said discharger plane for advancing said pusher to engage and to apply pressure to said front edge of said blank synchronously with the discharging of said blank from said discharge side until the angle between adjacent panels forming said front edge of said blank increases from substantially 0° to nearly 180°, and for retracting said pusher from said discharge side to a position where said blank is formed to a substantially square-shaped cross section; and d. at least one set of blank supporters, each said set of blank supporters being mounted adjacent said discharge side of said pair of discharging rollers for supporting both sides of said blank opened by pressure at said front edge in a direction perpendicular to said discharge plane; and at least one unloading conveyor for conveying said blank to a mandrel after said blank is formed to a substantially square-shaped cross section.

5. The device according to claim 4, wherein said pusher includes a receptacle, said receptacle having a V-shape with the opening being located substantially within said discharge plane facing said discharge side of said pair of discharging rollers to receive and to engage said front edge.

6. The device according to claim 5, further comprising a first stage opening means for opening said blank slightly prior to said pusher advancing to engage said front edge, said first stage opening means facing at least one side of said adjacent panels forming said front edge of said blank discharged from said discharge side.

7. The device according to claim 6, wherein said first stage opening means includes a contacting lever for contacting and moving along said front edge of said blank discharged from said pair of discharging rollers in said first direction, and a first stage opening lever, said opening lever having a pressing lever for increasing the angle between said adjacent panels from the flattened condition by pressing a projecting part of the upper panel of said adjacent panels.

8. A system for raising blanks from a rimpled and flattened parallelepipedic form to a rectangular parallelepiped form comprising:

a. a first and a second device for raising blanks from a rimpled and flattened parallelepipedic form to a rectangular parallelepiped form, each said device including:

a pair of discharging rollers, said rollers having an entry side and a discharge side;

a lifting conveyor, said lifting conveyor having a first end and a second end, said first end receiving said blanks for conveyance to said second end, said second end being located adjacent to said entry side of said pair of discharging rollers for providing a blank in a flattened and parallelepipedic form to said entry side of said pair of discharging rollers at a constant pitch to be discharged to said discharge side in a first direction along a discharge plane, said flattened form having an upper and a lower surface, each said surface having a front and a rear panel, said panels being joined by a central crease, and a front edge, said front edge being formed from a crease joint of said front panels of said upper and lower surfaces;

a pusher-moving mechanism, said mechanism being located along said discharge plane opposite to said discharge side of said pair of discharging rollers, said mechanism having a pusher, means to advance and to retract said pusher in said discharge plane, for advancing said pusher to engage and to apply pressure to said front edge discharged from said discharge side until the angle between said front panels forming said front edge from substantially 0° to nearly 180°, and for retracting said pusher from said discharge side to a location at which the blank is raised to a substantially square-shaped cross section, said means to advance and to retract said pusher synchronously with the discharging of each said blanks;

a set of blank supporters, said set of blank supporters being located adjacent said discharging side of said pair of discharging rollers for supporting said central edges of each of said blanks opened by pressure at said front edge when the angle between said front panels forming said front edge of said blank opens to nearly 180°;

an unloading conveyor for conveying said blanks to a mandrel after forming said blanks to a substantially square-shaped cross section;

b. a main conveyor, said main conveyor having a conveying surface for conveying blanks to each said first end of said first and said second device, said first and second devices being located in spaced relationship along the direction of conveyance of said conveying surface;

c. a moveable guide plate for changing conveyance direction of said blanks conveyed along said conveying surface in relation to said conveying surface, said moveable guide platė being located below said first end of said first device and being moveable between an advanced position and a retracted position in relation to said conveying surface for guiding every other of said blanks conveyed on said conveying surface to said first end of said first device; and d. a fixed guide plate for changing conveyance direction of said blanks conveyed along said conveying surface past said first device in relation to said conveying surface, said fixed guide plate being located below said first end of said second device for guiding said blanks remaining on said conveying surface to said first end of said second device, whereby said moveable guide plate is driven synchronously with the driving of said lifting conveyor of said first device and said main conveyor to guide said blanks conveyed on said conveying surface alternately into said first end and said second end of said first and said second devices, respectively.

* * * * *